US007845494B2

(12) United States Patent
Cerveny et al.

(10) Patent No.: US 7,845,494 B2
(45) Date of Patent: Dec. 7, 2010

(54) SECONDARY PACKAGE

(75) Inventors: Jean-Paul Cerveny, Vittel (FR); Klaus Hartwig, Nancy (FR)

(73) Assignee: Nestle Waters Management & Technology, Issy-les-Moulineaux (FR)

( * ) Notice: Subject to any disclaimer, the term of this patent is extended or adjusted under 35 U.S.C. 154(b) by 378 days.

(21) Appl. No.: 11/916,601

(22) PCT Filed: Jun. 2, 2006

(86) PCT No.: PCT/EP2006/005306

§ 371 (c)(1),
(2), (4) Date: Jan. 24, 2008

(87) PCT Pub. No.: WO2006/131279

PCT Pub. Date: Dec. 14, 2006

(65) Prior Publication Data

US 2008/0230420 A1 Sep. 25, 2008

(30) Foreign Application Priority Data

Jun. 8, 2005 (EP) ..... 05105024
Apr. 3, 2006 (EP) ..... 06007068

(51) Int. Cl.
*B65D 71/08* (2006.01)

(52) U.S. Cl. ..... 206/432; 206/497

(58) Field of Classification Search ..... 206/162, 206/201, 203, 427, 428, 430–432, 434, 497
See application file for complete search history.

(56) References Cited

U.S. PATENT DOCUMENTS 3,263,900 A * 8/1966 Link et al. ..... 229/240
3,416,653 A * 12/1968 Farquhar ..... 206/139
3,542,193 A * 11/1970 Hewlett et al. ..... 206/459.5
4,050,579 A 9/1977 Gorski et al.
4,119,202 A * 10/1978 Roth ..... 206/432
4,256,223 A * 3/1981 Pawlowski ..... 206/749
5,168,989 A 12/1992 Benno
5,228,564 A * 7/1993 Randeria ..... 206/443
5,361,905 A * 11/1994 McQueeny et al. ..... 206/494
5,857,570 A * 1/1999 Brown ..... 206/427
6,050,058 A * 4/2000 Loreto et al. ..... 206/432
6,105,776 A * 8/2000 Meilhon ..... 206/497
2005/0050857 A1 3/2005 Ono et al.

FOREIGN PATENT DOCUMENTS

FR 1 501 348 11/1967
FR 1 503 707 12/1967

* cited by examiner

*Primary Examiner*—Luan K Bui
(74) *Attorney, Agent, or Firm*—K&L Gates LLP

(57) ABSTRACT

The invention relates to a secondary package for gathering a plurality of primary packages, comprising an envelope that surrounds the plurality of primary packages so as to tightly hold the latter together. The secondary package also includes a base supporting the primary packages, lateral sides, and a top side, characterized in that: (i) said base comprises a medium folding line that pivotally connects two halves of the base supporting the primary packages, and the envelope further comprises a carrying handle that is disposed vertically along the medium folding line, and (ii) the lateral sides and the top side of the envelope comprise a transversal precut in the region of the medium folding line, and so that when the envelope is open along said precut, it still holds tightly the primary packages disposed on each of the two base halves and said halves can be pivoted around the medium folding line to allow complete access to the carrying handle.

24 Claims, 17 Drawing Sheets

SECONDARY PACKAGE

This application is a 371 of PCT/EP06/05306, filed on Jun. 2, 2006.

BACKGROUND

The present disclosure relates to a package, preferably a film package, for gathering a plurality of primary containers, such as bottles, that comprises an integrated handle.

In the field of gathering packages, the prior art shows packages to group a plurality of primary containers such as for example water bottles, or metal cans. These known packages are typically made out of a shrinkable film that is rolled around the set of bottles and heat-treated so as to shrink around the bottles to tightly hold them together. Once gathered, the primary packages, for example the bottles, form a pack.

In the following description, it will be considered for the sake of clarity that the gathering package is made out of a shrinkable film, and the primary packages are plastic bottles. However, this limitation should not be considered as restricting the scope of the invention. Other types of materials than shrinkable plastic film may also be used for the gathering package, and other types of primary packages than plastic bottles may be gathered.

The interest of such film gathering packages has been known for long, and is a consumer must to facilitate handling and transportation of a set of primary containers.

Some of the known film gathering packages comprise a handle that is glued onto the outer surface of the film by means of adhesive tape for example.

These known film gathering packages show good reliability for consumers because they provide good gathering of the primary containers—for example bottles of mineral water—and the handle facilitates handling.

However, when a consumer is shopping and wishes to transport the pack of bottles into a shopping trolley, it is necessary to place the pack into the trolley. However, such a pack is usually quite bulky and a lot of space into the trolley is lost for filling with other products.

Therefore, a need exists for a package for gathering a plurality of primary packages, that is easy to handle and that can be arranged in a shopping trolley in such a way that a maximum of space remains available into said trolley.

SUMMARY

The present disclosure addresses the problems set out above with a secondary package for gathering a plurality of primary packages, including an envelope that surrounds the plurality of primary packages so as to tightly hold the latter together and so that said secondary package has a generally flat configuration. The secondary package includes a base member supporting the primary packages. The envelope has a bottom side, lateral sides, and a top side.

According to the present disclosure, the secondary package is characterized in that:

its base has a folding line that pivotally connects two portions of the base supporting the primary packages, the lateral sides and the top side of the envelope include a transversal predetermined weakness line in the region of the folding line, such that when the envelope is at least partially opened along said weakness line, it still holds tightly the primary packages disposed on each of the two portions and said portions can be pivoted around the folding line to allow compaction of the secondary package from its flat, unfolded, configuration into a compact configuration.

In an embodiment, the predetermined weakness line is a precut line, and also preferably, the folding line is located in the medium part of the base.

In an embodiment of the present disclosure, the envelope of the secondary package includes a carrying handle that is disposed vertically between the portions of the base.

In this case, said carrying handle may be disposed in said envelope, such that it is accessible only after said secondary package is folded in its compacted configuration.

Said handle can be a strip that is fixed along the medium folding line of the envelope base.

In an embodiment, said handle can be glued to the external surface of the envelope, the precut portion including two precut lines that are substantially parallel to one another.

In all cases, the base is preferably reinforced by an independent secondary base.

In this case, said secondary base can be made out of a corrugated plastic board, and is preferably rigid.

In another embodiment, the portions of the base are symmetrical along the folding line.

Preferably, said envelope is made out of a thermoshrinkable film.

In an alternative embodiment, said envelope is a net.

The present disclosure is preferably meant to be used such that the primary packages are water-containing plastic bottles.

In an alternative embodiment, the secondary package is a secondary package for gathering a plurality of primary packages, including a horizontal flat base for supporting at least some of said plurality of primary packages, and an envelope that surrounds the base and the plurality of primary packages so as to tightly hold the latter together characterized in that:

(i) said base has a medium folding line that pivotally connects two halves of the base supporting the primary packages, and further includes a carrying handle that is disposed vertically between the base halves, along the medium folding line, and (ii) said envelope includes a transversal precut in the region of the folding line, at least along the lateral sides and the top side of the secondary package, so that when the envelope is open along said precut, it still holds tightly the primary packages disposed on each of the two base halves, and said halves can be pivoted around the medium folding line to allow access to the carrying handle.

As can be understood from the above, the secondary package according to the present disclosure is particularly advantageous as it allows several types of uses, as explained in detail in the following detailed description of one particular example of the present disclosure.

In an embodiment of the present disclosure, the base is made out of a single die cut that has two secondary folding lines each disposed in one half of the base, said secondary folding lines being parallel and equidistant from the medium folding line of the base, two holes being symmetrically disposed between the medium and secondary folding lines, said handle being formed by folding the die cut along the medium and secondary folding lines.

According to this embodiment, the vertical handle that is disposed between the base halves that support the primary packages, is made in one piece and is integral with the rest of the base. This manufacturing solution is particularly cost-effective and simple to assemble in the factory.

Also, in an embodiment of the present disclosure, the shape of the flat base corresponds to the contours of the envelope, the width of the base in the region of the medium folding line, being inferior to the maximum width of each half of said base.

In this case, the flat base is prevented from slipping out of the rest of the secondary package when the precut has been used to open the envelope in two halves and the secondary package is in the open configuration.

Alternatively, said handle could be made out of a strip that is fixed along the medium folding line of the base.

In one embodiment, both halves of the base are symmetrical along the medium folding line.

Furthermore, the envelope of the secondary package is preferably made out of a thermoshrinkable film, and/or said base made out of a corrugated plastic board. However, another material could be used, such as a reinforced cardboard sheet, so that it is especially resistant to traction forces, and also humidity proof.

In an embodiment, the flat base is rigid.

BRIEF DESCRIPTION OF THE FIGURES

Additional features and advantages of the present disclosure are described in, and will be apparent from, the description of the present embodiments which are set out below with reference to the drawings in which.

DETAILED DESCRIPTION

Figure 1:
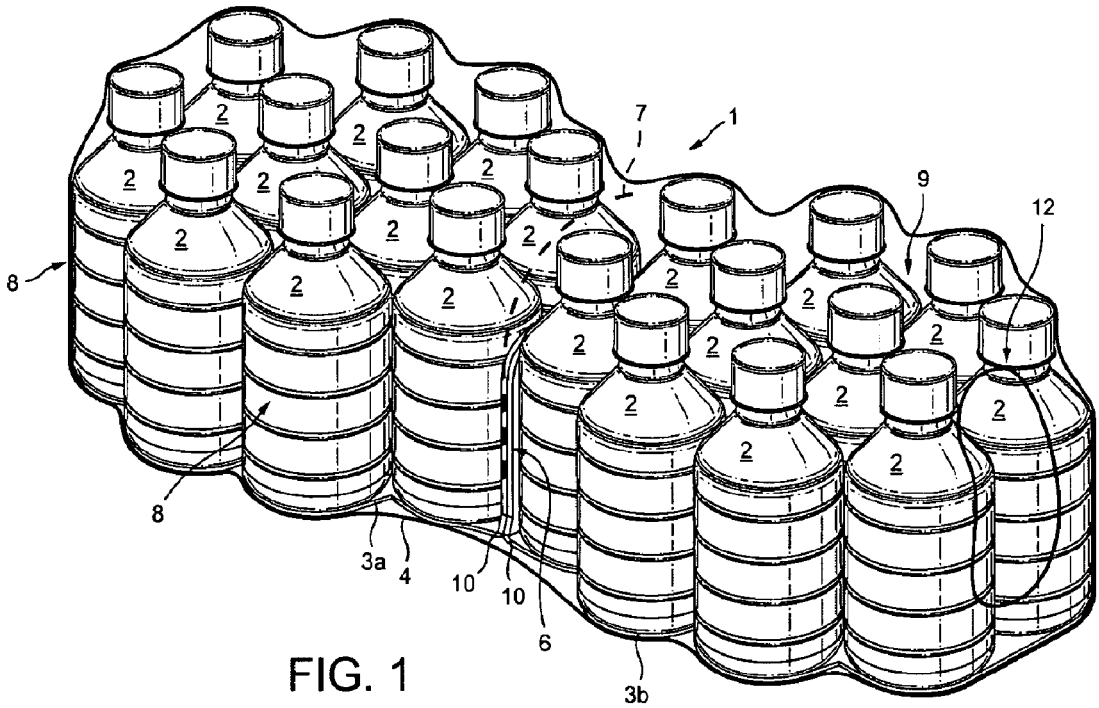
FIG. 1 is a perspective top view of a secondary package in accordance with an embodiment of the present disclosure.

The secondary package 1 according to the present disclosure, and as shown in FIG. 1, is meant for gathering a plurality of primary packages 2. In the particular embodiment as described hereafter in detail, the primary packages are plastic bottles 2 containing water.

The secondary package 1 according to the present disclosure comprises a base member 3 and an envelope 4 that surrounds the plurality of primary packages 2 so as to tightly hold the latter together.

Figure 2:
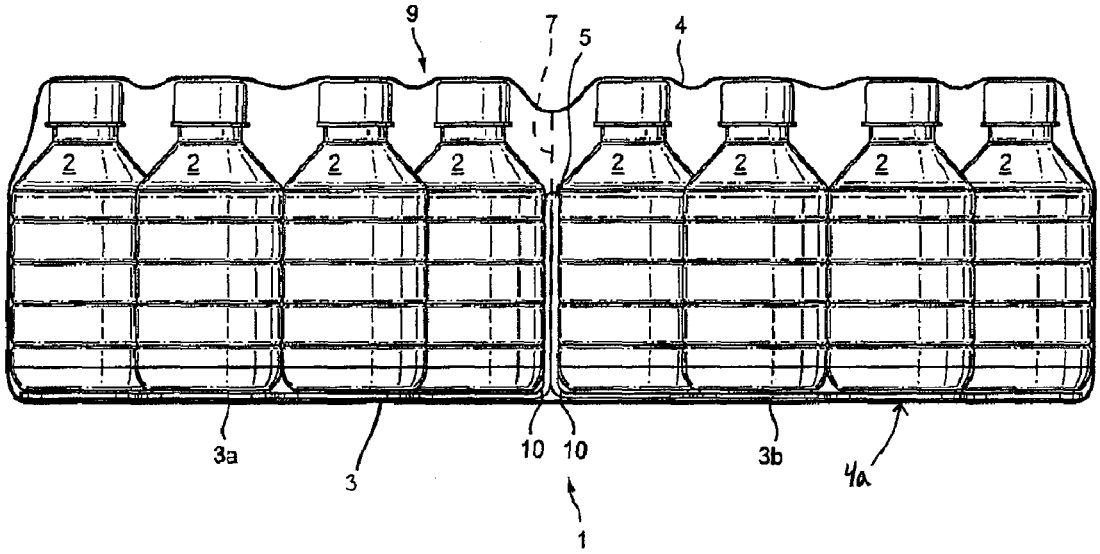
FIG. 2 is a side view of a secondary package in accordance with an embodiment of the present disclosure.

As shown in FIGS. 1 and 2, said envelope 4 comprises a bottom side 4*a* that assists in supporting the primary packages 2, as well as lateral sides 8, and a top side 9.

According to the present disclosure, the base 3 comprises a medium folding line 5 that pivotally connects two halves 3*a*, 3*b* of the base 3 supporting the primary packages 2. The base 3 further comprises a carrying handle 6 that is disposed vertically along the medium folding line 5, as is shown in FIG. 5.

Figure 3:
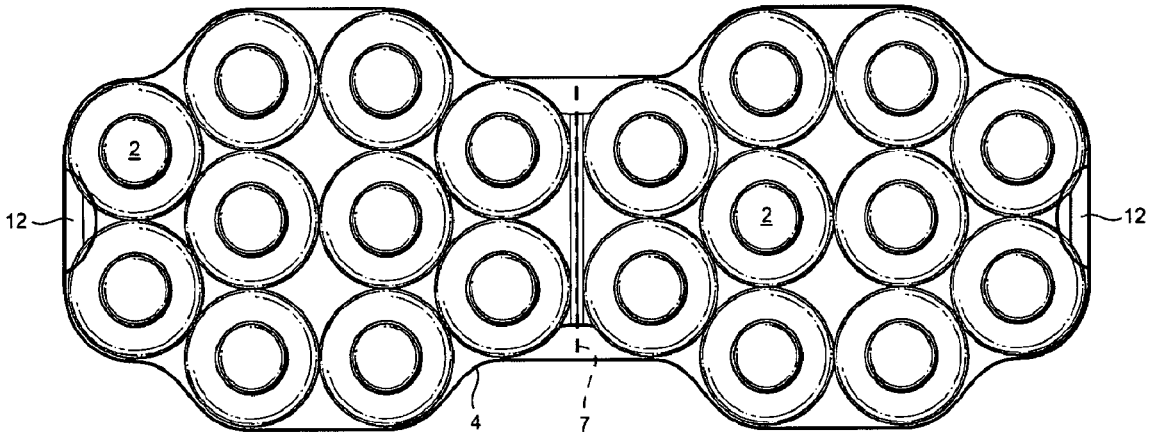
FIG. 3 is a top view of a secondary package in accordance with an embodiment of the present disclosure.
Figure 4:
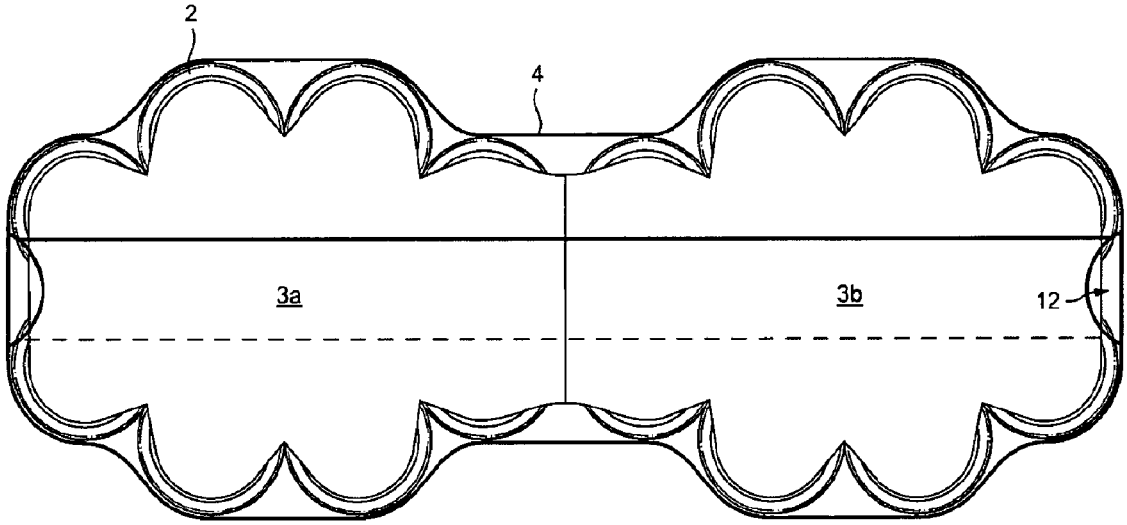
FIG. 4 is a bottom view of a secondary package in accordance with an embodiment of the present disclosure.

Also according to the present disclosure, the lateral sides 8 and the top side 9 of the envelope 4 comprise a transversal precut 7 in the region of the medium folding line 5, as shown in FIGS. 1-3.

Figure 5:
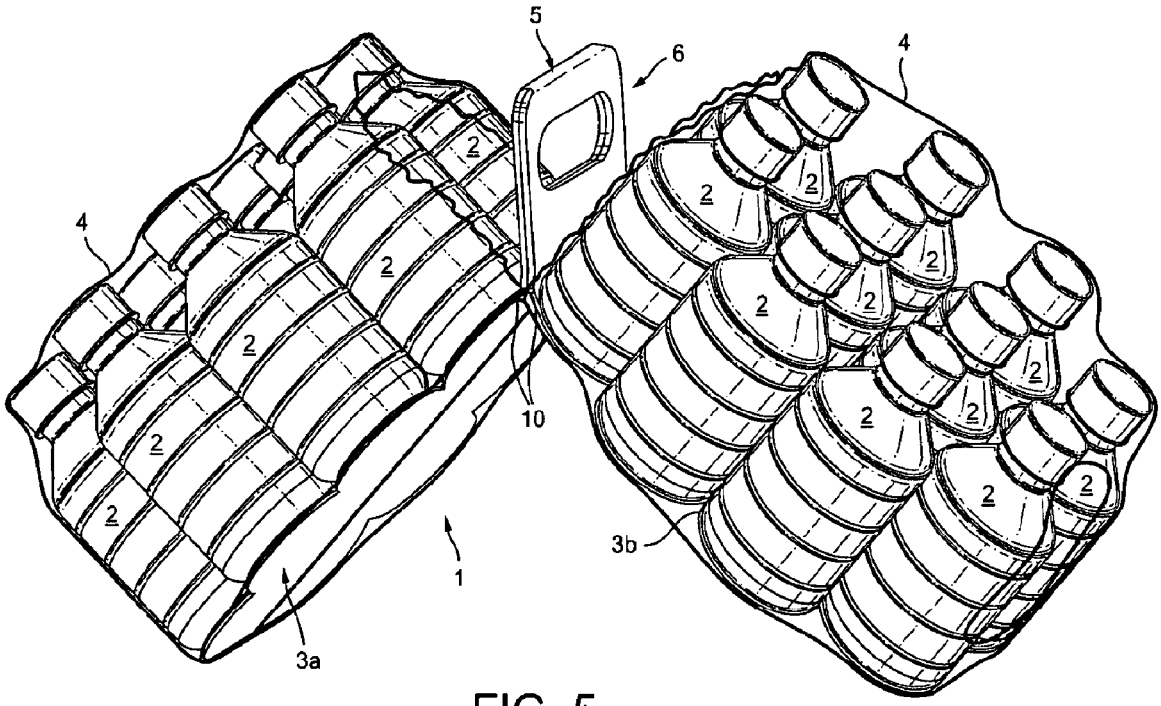
FIG. 5 is a perspective side view of a secondary package in accordance with an embodiment of the present disclosure.
Figure 6:
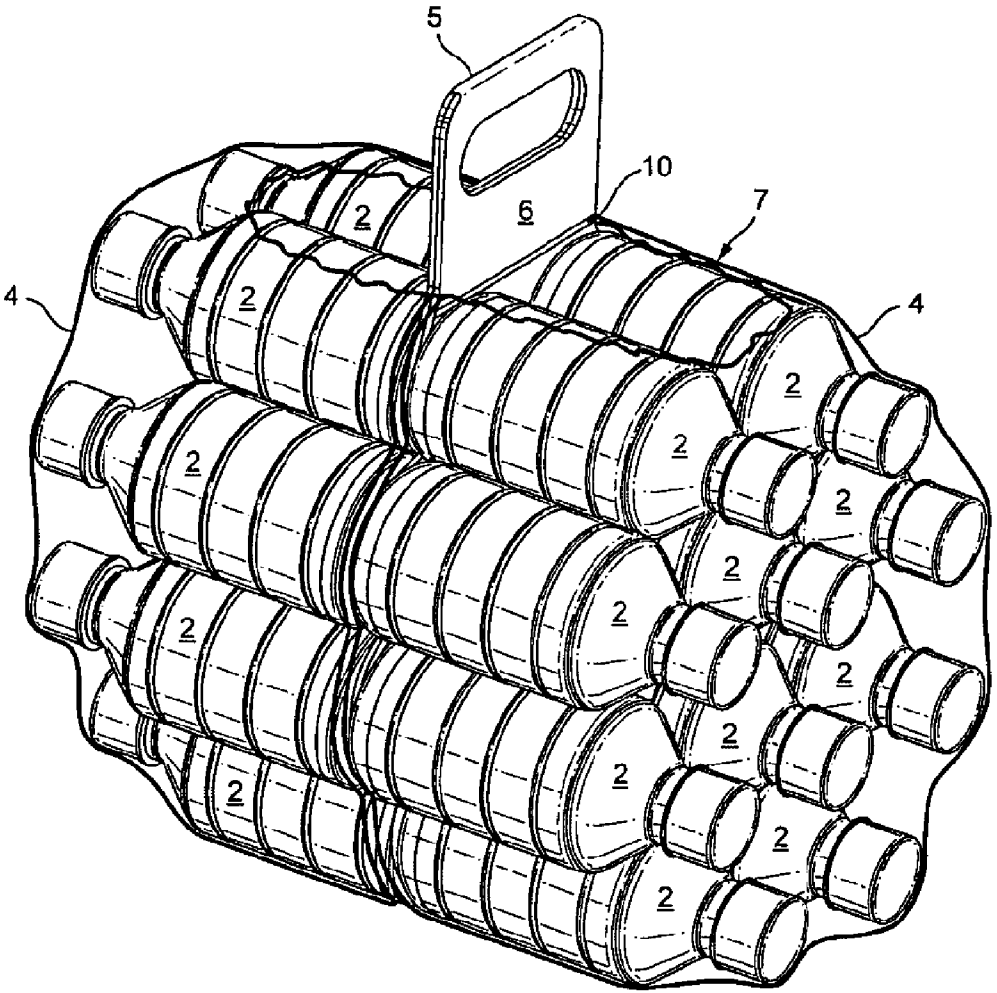
FIG. 6 is a perspective side view of a secondary package in accordance with an embodiment of the present disclosure.

Therefore, as shown in FIGS. 5 and 6, when the envelope 4 is open along said precut 7, said envelope 4 still holds tightly the primary packages 2 disposed on each of the two base halves 3*a*, 3*b*, and said halves 3*a*, 3*b* can be pivoted around the medium folding line 5 in order to allow complete access to the carrying handle 6.

By "complete" access to the carrying handle it is meant that, although said handle is disposed outside of the envelope, when the secondary package is in its closed configuration, i.e. when the precut line has not been broken, the handle is not really accessible for the consumer because it is tightly adapted to the envelope and there is almost no gap between said handle and said envelope. Therefore, the consumer cannot insert is hand between said envelope and said handle, in order to grab the latter. On the contrary, when the precut has been broken and the secondary package is in its open configuration as illustrated in FIG. 6, said handle is clear from the envelope and therefore completely accessible to the consumer.

Figure 10:
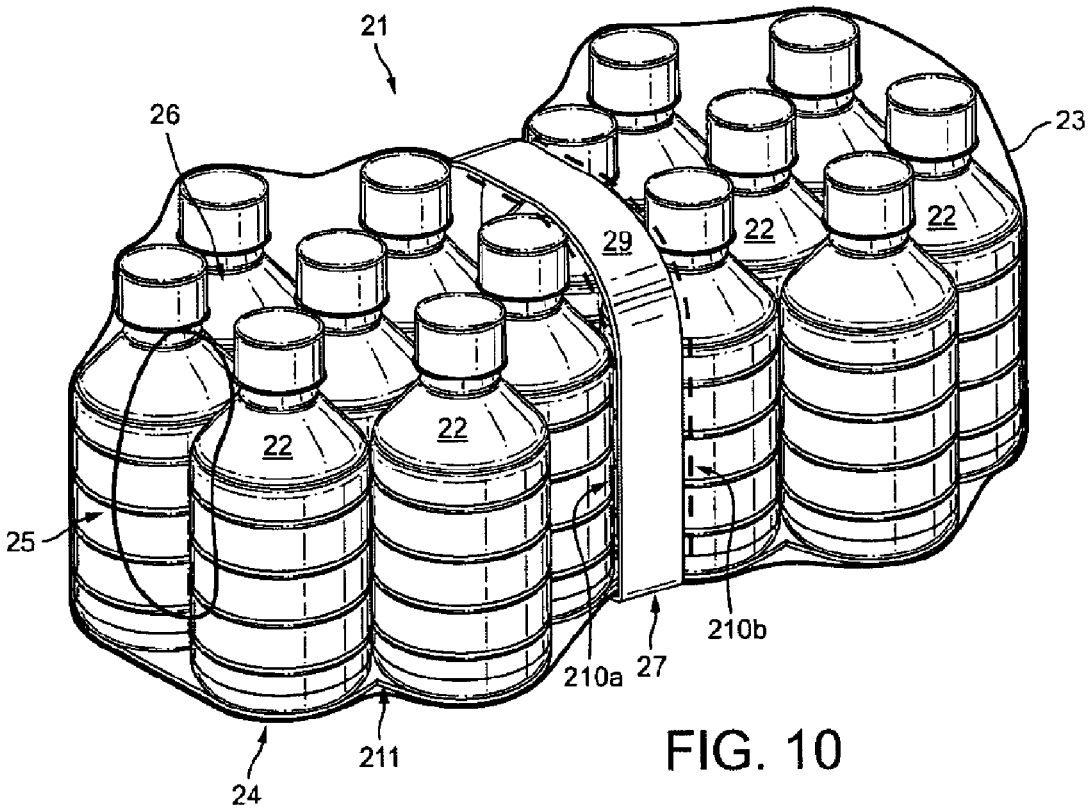
FIG. 10 is a perspective side view of a secondary package in accordance with an embodiment of the present disclosure.
Figure 11:
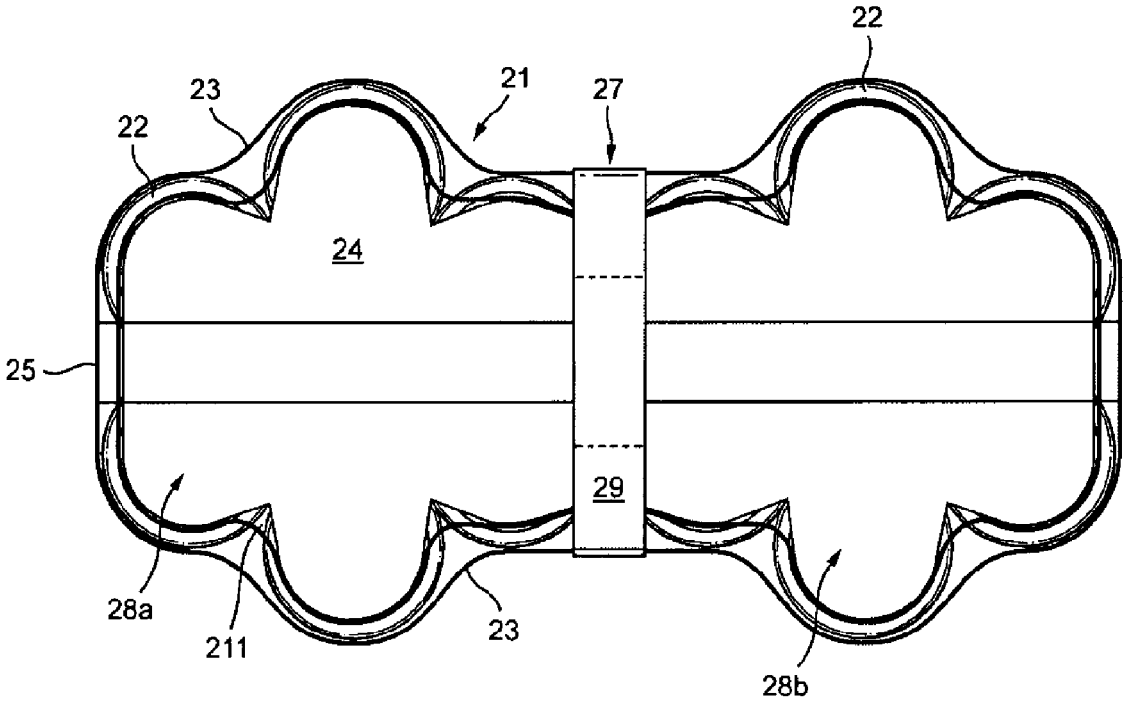
FIG. 11 is a bottom view of a secondary package in accordance with an embodiment of the present disclosure.
Figure 12:
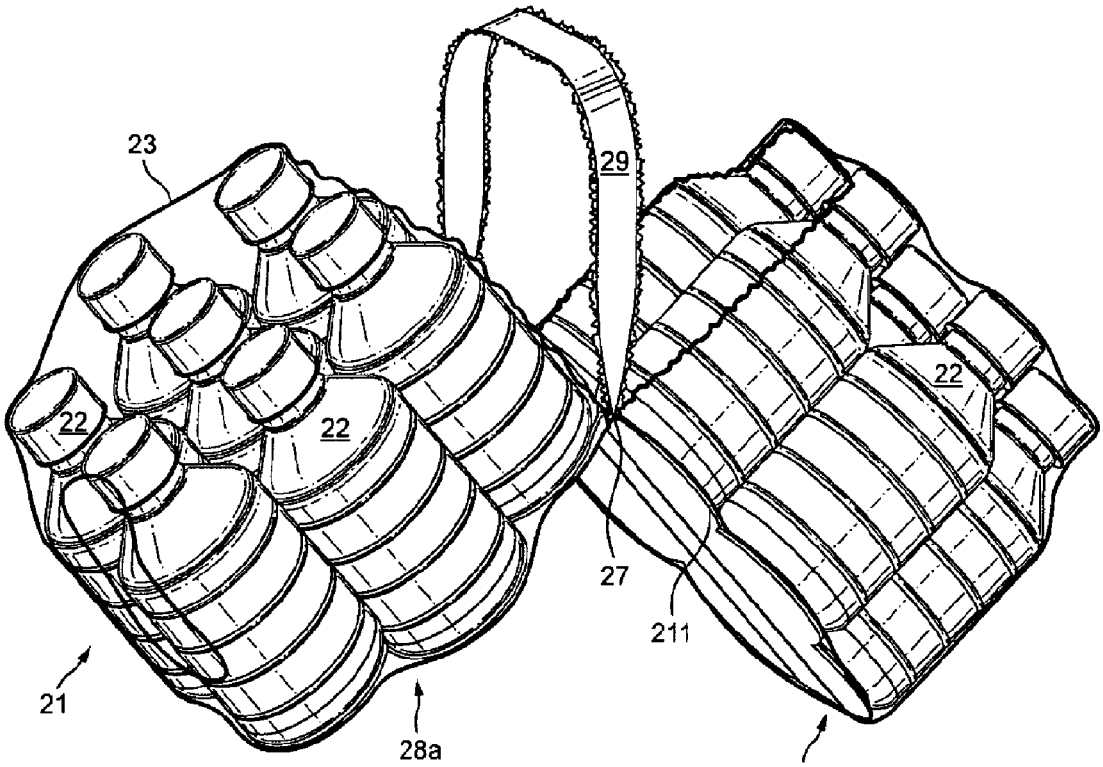
FIG. 12 is a perspective side view of a secondary package in accordance with an embodiment of the present disclosure.
Figure 13:
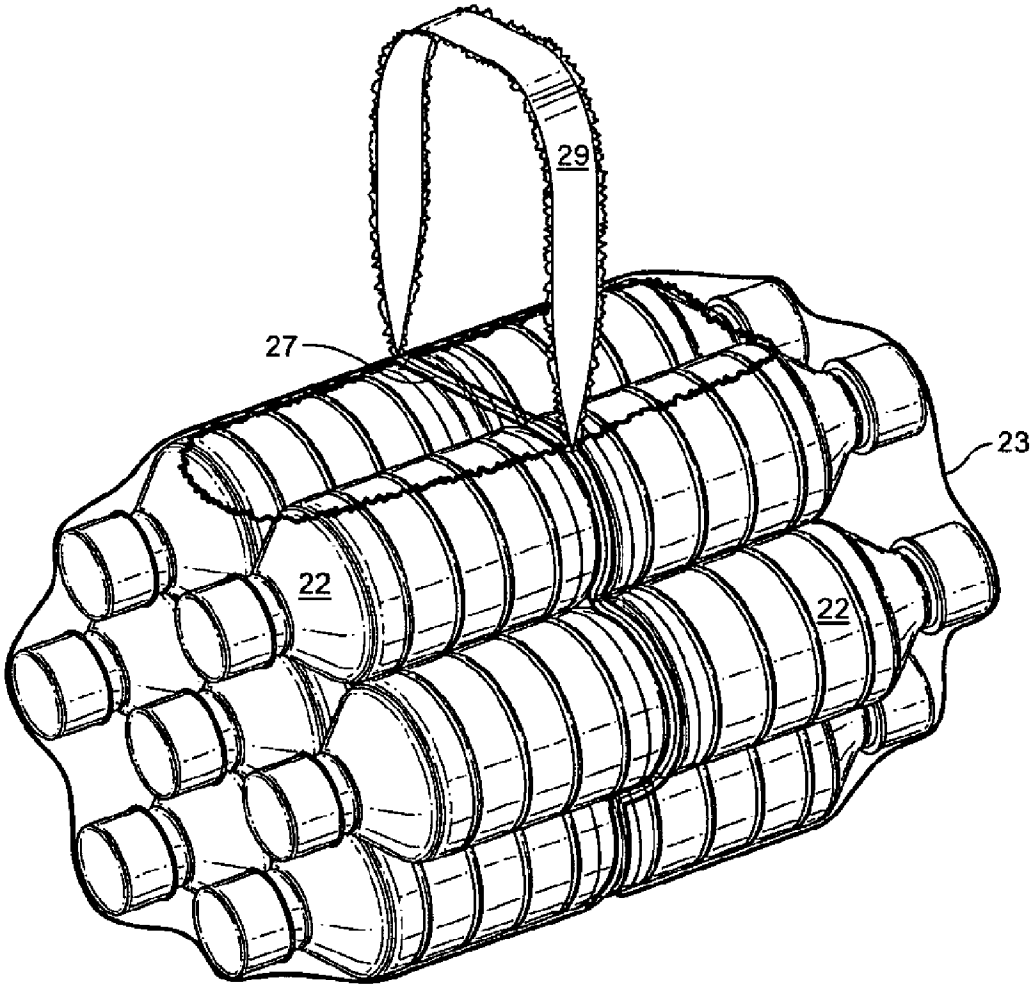
FIG. 13 is a perspective side view of a secondary package in accordance with an embodiment of the present disclosure.

In an embodiment of the present disclosure illustrated in FIGS. 10-12, a base member 24 is reinforced by an independent secondary base 211.

In this particular embodiment, said secondary base 211 is made out of a rigid corrugated plastic board. Furthermore, in this embodiment, a precut 210 comprises two precut lines 210*a*, 210*b* that are substantially parallel to one another.

Figure 14:
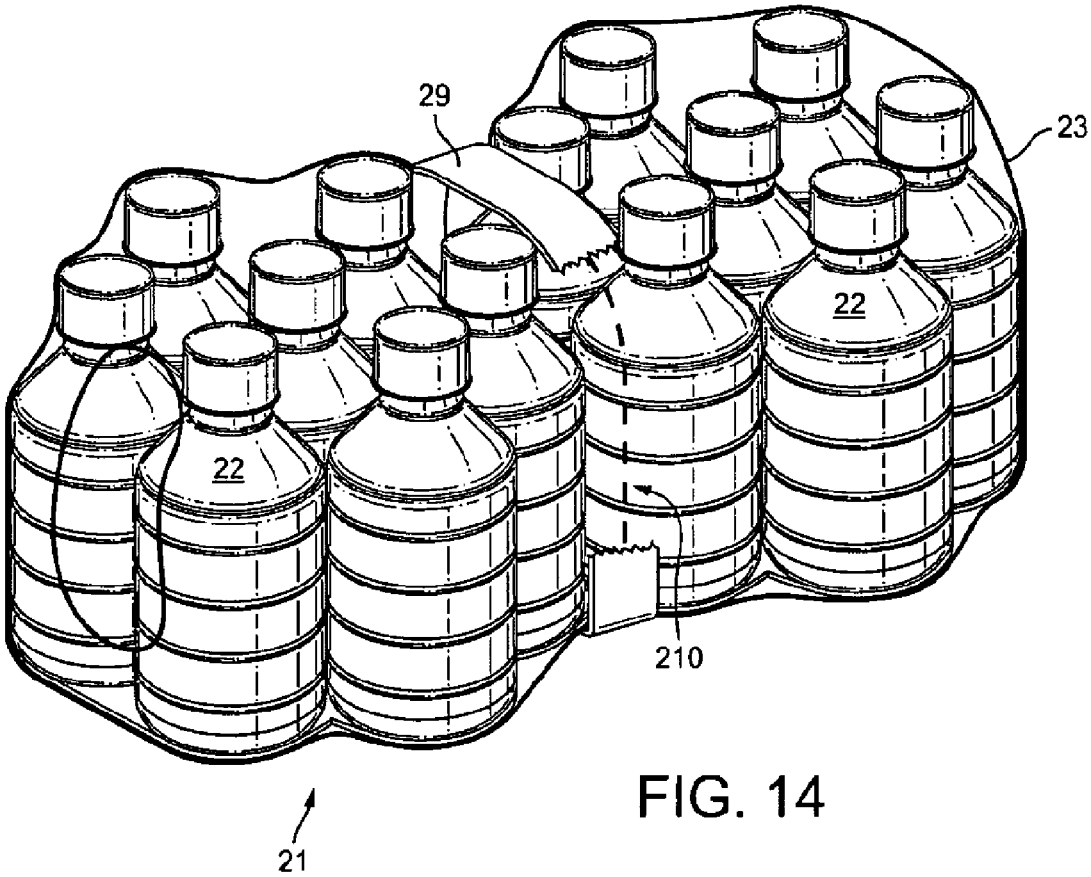
FIG. 14 is a perspective side view of a secondary package in accordance with an embodiment of the present disclosure.
Figure 15:
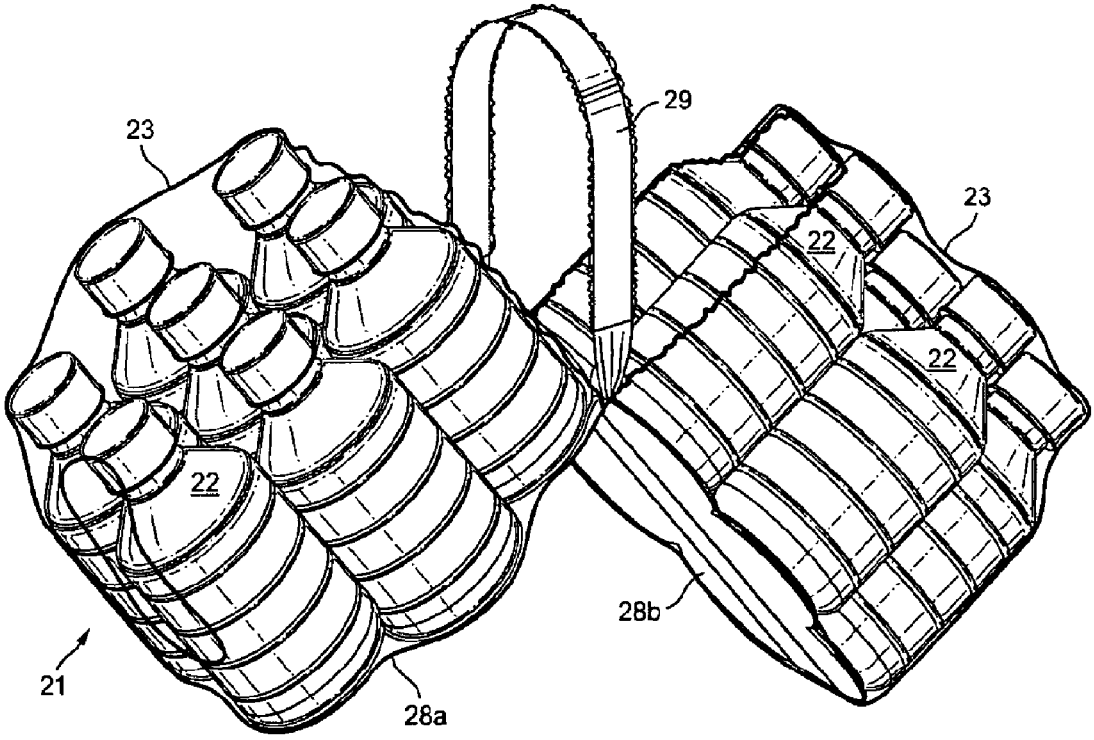
FIG. 15 is a perspective side view of a secondary package in accordance with an embodiment of the present disclosure.
Figure 16:
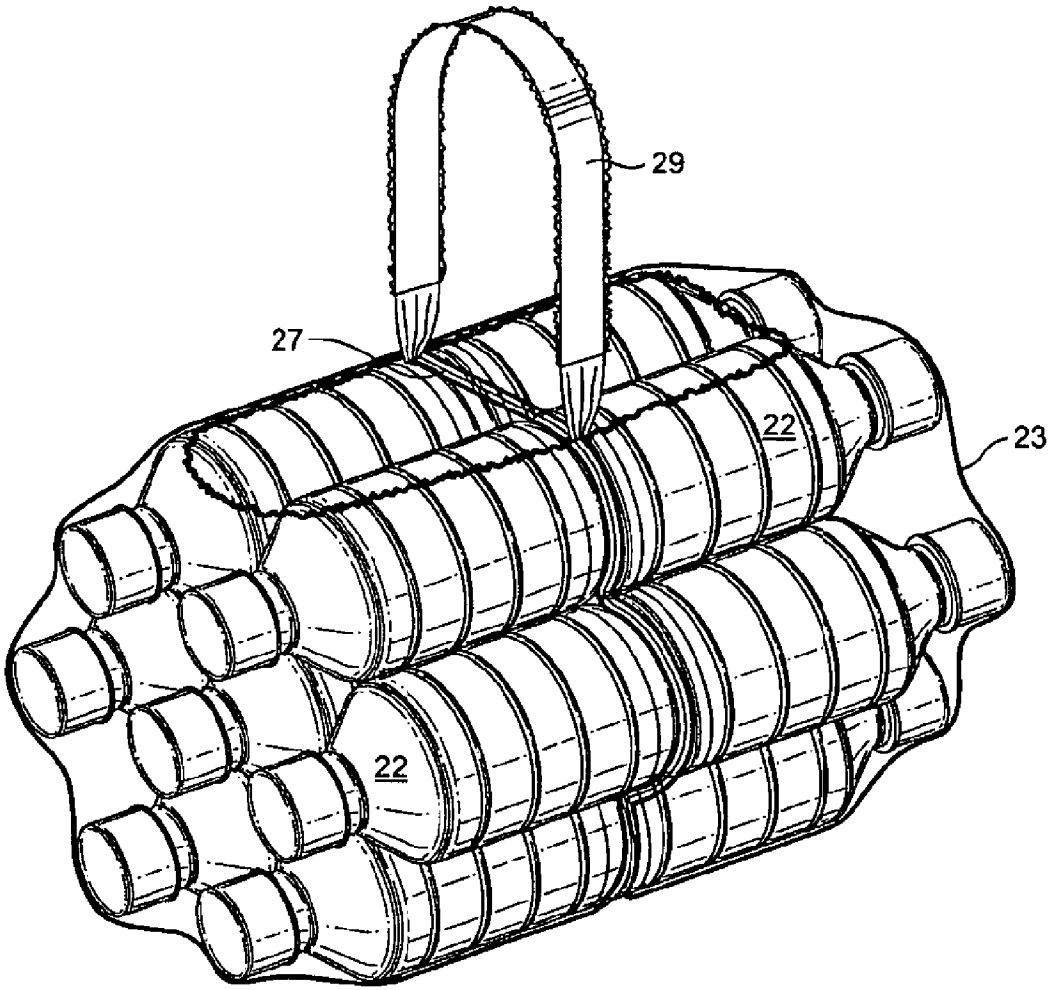
FIG. 16 is a perspective side view of a secondary package in accordance with an embodiment of the present disclosure.

In another embodiment of the present disclosure illustrated in FIGS. 14-16, the base 24 is not reinforced and comprises solely the material making the whole envelope. The carrying handle 29 is a strip of thick film that surrounds said envelope 23, and that is attached to the latter by glue that is disposed at the interface between said handle and said envelope, in the base region of said envelope.

In both embodiments described hereinbefore, both halves 28*a*, 28*b* of the base 24 are symmetrical along a medium folding line 27.

Furthermore, the envelope 23 is made out of a thermoshrinkable film.

Figure 9:
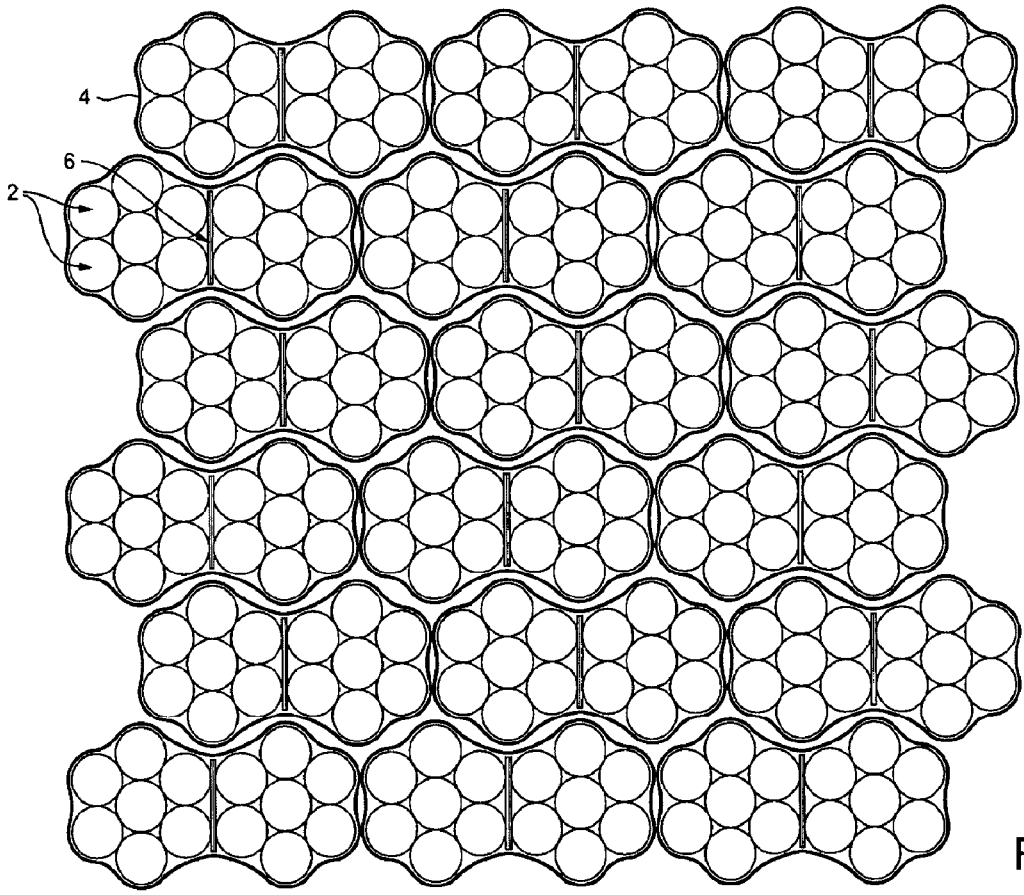
FIG. 9 is a schematic top view of a plurality of secondary packages, disposed adjacent to one another in a pallet layer in accordance with an embodiment of the present disclosure.
Figure 17:
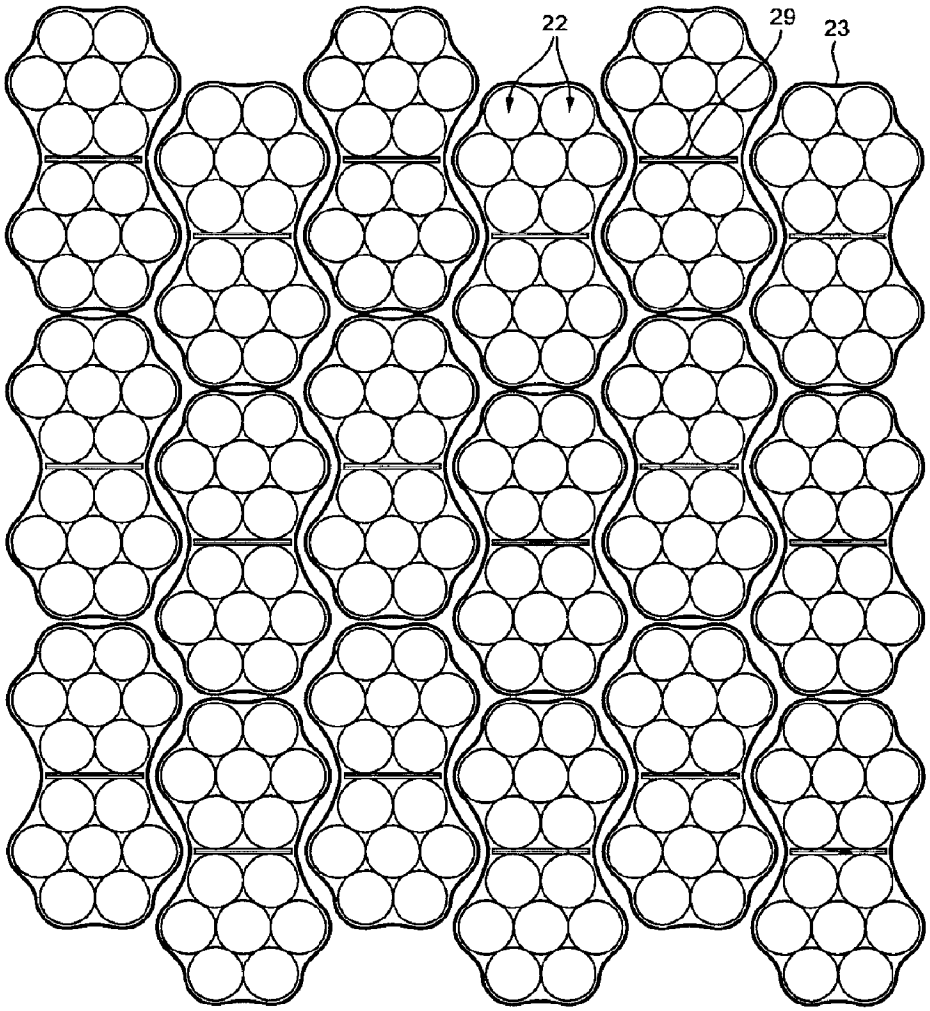
FIG. 17 is a schematic top view of a plurality of secondary packages disposed adjacent to one another in a pallet layer in accordance with an embodiment of the present disclosure.

As can be seen in FIGS. 9 and 17, the disposition of the water bottles 2, 22 on the base 3, 24, and the fact that the contours of said base 3, 24 is adapted to the disposition of the water bottles, makes it convenient to place several secondary packages of the invention, such that adjacent secondary packages are interlocked. This allows for building compact and strong layers of secondary packages in a pallet.

The secondary package 21 according to an embodiment of the present disclosure, as shown in FIGS. 10-11, is also meant for gathering a plurality of primary packages 22. In the particular embodiment as described hereafter in detail, the primary packages are water containing plastic bottles 22.

The secondary package 21 comprises a horizontal rigid flat base 24 made out of corrugated plastic board, for supporting said water bottles 22. The secondary package 21 further comprises an envelope 23 that surrounds the base 24. The envelope 23 is heat shrinkable thermoplastic envelope tightly holds the bottles 22 together.

According to the present disclosure, the secondary package 21 is characterized in that:

(i) the base 24 comprises a medium folding line 27 that pivotally connects two halves 28*a*, 28*b* of the base 24 supporting the primary packages 22—both halves of the base 28*a*, 28*b* being symmetrically disposed across the folding line 27, and said base 24 further comprises a carrying handle 29 that is disposed vertically between the base halves 28*a*, 28*b*, along the medium folding line 27, and (ii) the envelope 23 comprises a transversal precut 210 in the region of the medium folding line 27, along the lateral sides 25 and the top side 26 of the secondary package 21, so that when the envelope 23 is open along said precut 210, it still holds tightly the primary packages 22 disposed on each of the two base halves 28*a*, 28*b*, and said halves 28*a*, 28*b* can be pivoted around the medium folding line 27 to allow access to the carrying handle 29.

As can be understood from the above, the secondary package 1, 21 according to the present invention is particularly advantageous as it allows at least three different types of configurations and uses.

Firstly, as shown in FIGS. 1-6, when the envelope 4 is not open along the precut line 7, the two halves 3*a*, 3*b* of the base 3 are in the same plane, and the carrying handle 6 does not protrude from said envelope 4. In this configuration, the profile of the secondary package 1 is generally parallelepipedic and allows for piling several layers of such packages 1 in a pallet for storing and transportation (not represented in the drawings).

Secondly, when a consumer takes the secondary package in a store, the envelope 4 can be open along the precut 7 as shown in FIG. 5, and the two halves 3*a*, 3*b* of the base 3 can be pivoted around the medium folding line 5—that is used as a hinge—in order to reveal the carrying handle 6 that becomes accessible to a user. At that time, it is very easy to carry the whole secondary package 1 using the handle 6, and the envelope 4 still holds the water bottles 22 disposed on each half 3*a*, 3*b* of the base 3, as shown in FIG. 6.

Figure 8:
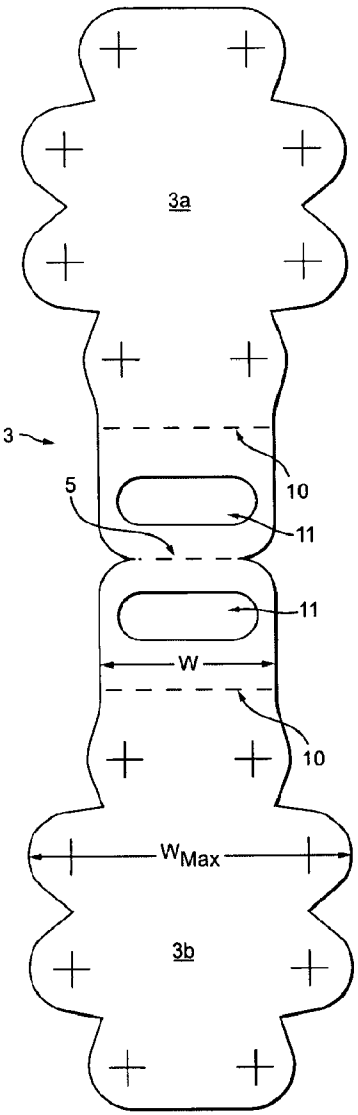
FIG. 8 is a schematic top view of a secondary package in accordance with an embodiment of the present disclosure.

In that case, as can be seen in FIG. 8, the shape of the flat base 3 corresponds to the contours of the envelope 4, and the width W of the base 3 in the region of the medium folding line 5 is inferior to the maximum width $W_{max}$ of each half 3*a*, 3*b* of said base 3. Therefore, it is impossible for the base 3 to slip outside of the envelope 4 when the latter is open along the precut as shown in FIG. 6.

Figure 7:
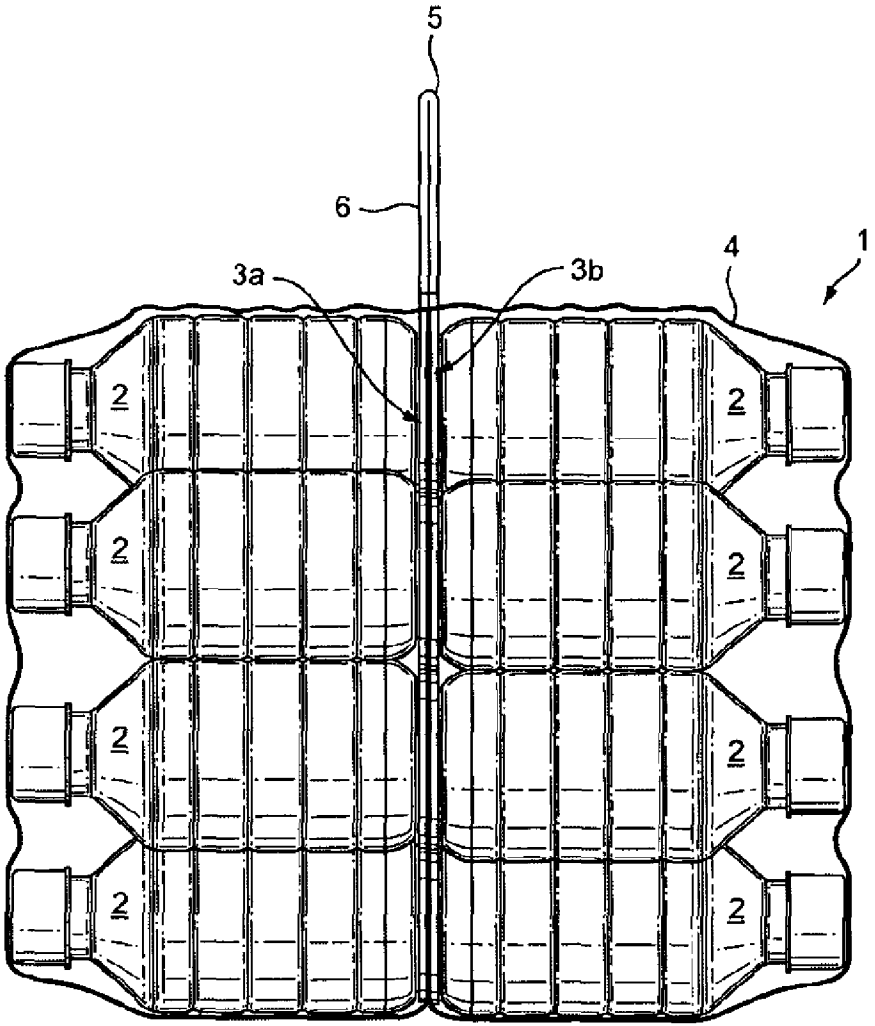
FIG. 7 is a side view of a secondary package in accordance with an embodiment of the present disclosure.

Also in that case, as shown in FIG. 8, the base 3 is made out of a single die cut that comprises two secondary folding lines 10 each disposed in one half 3*a*, 3*b* of the base. These folding lines 10 are parallel and equidistant from the medium folding line 5 of the base 3. Furthermore, two holes 11 are symmetrically disposed between the medium 5 and secondary 10 folding lines, and said handle is formed by folding the die cut of the base 3 along the medium 5 and secondary 10 folding lines. The vertical handle 6 that is disposed between the base halves 3*a*, 3*b* that support the primary packages 22, is made in one piece and is integral with the rest of the base 3 as can be seen in FIGS. 6-8.

Thirdly, when a consumer wishes to place the purchased package 1 of water bottles 2 in a trolley (not shown in the drawings), it is easy to place said secondary package 1 astride a side wall of the trolley, such that: one half of the secondary package is disposed inside the trolley, and the other half of the secondary package hangs outside the trolley, so as to save space in the trolley for other purchases.

As can be seen in FIGS. 1 and 3, the envelope 4 of the secondary package 1 is made out of a thermoshrinkable film. Consequently, the envelope 4 does not cover the entire surface of the water bottles 2 held inside, and windows 12 in the envelope 4 are disposed at each extremity of the secondary package 1, as can be seen particularly in FIG. 3.

As can be seen in FIG. 9, the disposition of the water bottles 2 on the base 4, and the fact that the contours of said base 4 is adapted to the disposition of the water bottles, makes it convenient to place several secondary packages of the invention, such that adjacent secondary packages are interlocked. This allows for building compact and strong layers of secondary packages in a pallet.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A secondary package for a plurality of primary packages, comprising an envelope that surrounds a plurality of primary packages, the secondary package comprising: a generally flat configuration, the envelope comprising a bottom side supporting the primary packages, lateral sides, and a top side; and a base member comprising a folding line that pivotally connects two portions of the base member, the lateral sides and the top side of the envelope comprise a transversal predetermined weakness portion in the region of the folding line, such that when the envelope is at least partially opened along the weakness portion, it still holds tightly the primary packages disposed on each of the two portions and the two portions can be pivoted around the base folding line to allow compaction of the secondary package from the flat, unfolded, configuration into a compact configuration.

2. A secondary package according to claim 1, wherein the predetermined weakness portion is a precut line.

3. The secondary package according to claim 2, wherein the base folding line is located in a middle portion of the base member.

4. The secondary package according to claim 2, wherein the base member comprises a carrying handle that is disposed vertically between the two portions of the base member.

5. The secondary package according to claim 4, wherein the carrying handle is disposed in the base member, such that it is accessible only after the secondary package is folded in into the compacted configuration.

6. The secondary package according to claim 4, wherein the handle is a strip that is fixed along the base folding line.

7. The secondary package according to claim 1, wherein a handle is glued to an external surface of the envelope, the predetermined weakened portion comprising two precut lines that are substantially parallel to one another.

8. The secondary package according to claim 1, wherein the base member is reinforced by an independent secondary base.

9. The secondary package according to claim 8, wherein the secondary base is made out of a corrugated plastic board.

10. The secondary package according to claim 8, wherein the secondary base is rigid.

11. The secondary package according to claim 1, wherein the two portions of the base member are symmetrical along the folding line.

12. The secondary package according to claim 1, wherein the envelope is made out of a thermoshrinkable film.

13. The secondary package according to claim 1, wherein the envelope is a net.

14. The secondary package according to claim 1, wherein the primary packages are water-containing plastic bottles.

15. A secondary package for gathering a plurality of primary packages, comprising:

a horizontal flat base supporting a plurality of primary packages, and an envelope that surrounds the base and the plurality of primary packages so as to tightly hold the plurality of primary packages together;

the base comprises a medium folding line that pivotally connects two halves of the base supporting the primary packages, and further comprises a carrying handle that is disposed vertically between the two base halves, along the medium folding line, and the envelope comprises a transversal precut portion in the region of the medium folding line, at least along lateral sides and a top side of the secondary package, so that when the envelope is open along the precut portion, it still holds tightly the primary packages disposed on each of the two base halves, and the two base halves can be pivoted around the medium folding line to allow access to the carrying handle.

16. The secondary package according to claim 15, wherein a shape of the flat base corresponds to contours of the envelope, a width W of the base in the region of the medium folding line being inferior to a maximum width $W_{max}$ of each half of the base.

17. The secondary package according to claim 15, wherein both halves of the base are symmetrical along the medium folding line.

18. The secondary package according to claim 15, wherein the envelope is made out of a thermoshrinkable film.

19. The secondary package according to claim 15, wherein the base is made out of a corrugated plastic board.

20. The secondary package according to claim 15, wherein the horizontal flat base is rigid.

21. The secondary package according to claim 15, wherein the primary packages are water-containing plastic bottles.

22. A secondary package for holding a plurality of primary packages comprising:

an envelope that surrounds a plurality of primary packages having a generally flat configuration, the envelope comprising a bottom side supporting the primary packages, lateral sides, and a top side;

a base member comprising a folding line that pivotally connects two portions of the base member; and the lateral sides and the top side of the envelope comprise a predetermined weakness line in the region of the folding line, such that when the envelope is at least partially opened along the weakness line, it still holds the primary packages disposed on each of the two portions and the portions can be pivoted around the folding line.

23. A secondary package for gathering a plurality of primary packages, comprising:

a horizontal flat base supporting a plurality of primary packages, and an envelope that surrounds the base and the plurality of primary packages so as to tightly hold the plurality of primary packages together;

the base comprises a medium folding line that pivotally connects two halves of the base supporting the primary packages, and further comprises a carrying handle that is disposed vertically between the base halves, along the medium folding line, and the envelope comprises a transversal precut in the region of the medium folding line, at least along the lateral sides and the top side of the secondary package, so that when the envelope is open along the precut, it still holds tightly the primary packages disposed on each of the two base halves, and the halves can be pivoted around the medium folding line to allow access to the carrying handle, wherein the base is made out of a single die cut that comprises two secondary folding lines, one disposed in each half of the base, the secondary folding lines being parallel and equidistant from the medium folding line of the base, two holes being symmetrically disposed between the medium and secondary folding lines, the handle being formed by folding the die cut along the medium and secondary folding lines.

24. The secondary package according to claim 23, wherein the two portions of the base forming the handle are glued together.

* * * * *